United States Patent [19]

Ruhlandt

[11] 4,304,278

[45] Dec. 8, 1981

[54] GOLF CLUB TUBE HOLDER FOR GOLF BAG

[76] Inventor: Phillip S. Ruhlandt, 29485 Milton, Madison Heights, Mich. 48071

[21] Appl. No.: 106,087

[22] Filed: Dec. 21, 1979

[51] Int. Cl.[3] ..... A63B 55/00

[52] U.S. Cl. ..... 150/1.5 R; 211/60 G; 285/192

[58] Field of Search ..... 150/1.5 R, 1.5 B, 1.5 C; 211/60 G, 60 R; 285/192, 196; 403/230

[56] References Cited

U.S. PATENT DOCUMENTS

| | | | |
|---|---|---|---|
| 1,731,588 | 10/1929 | Patterson | 150/1.5 R |
| 2,295,910 | 9/1942 | Olson | 285/192 X |
| 2,390,393 | 12/1945 | Rubly | 285/192 X |
| 2,860,679 | 11/1958 | Kouke | 150/1.5 R |
| 3,534,795 | 10/1970 | Wiedenmeier | 150/1.5 R |

*Primary Examiner*—Donald F. Norton
*Attorney, Agent, or Firm*—Gerald R. Hershberger

[57] ABSTRACT

A golf club protector tube retainer for golf bags, comprises a flat plate having a plurality of apertures for receiving the individual protection tubes. Tube clamping and securing means having a resilient individually compressible deformable friction member is provided at each aperture for gripping the walls of each inserted tube.

The tube retainer plate is held in the open end of the bag by a bag strap which partially encircles the bag and is passed through loops in the golf bag to engage a pair of hangers mounted on opposite ends of the plate adjacent said loops.

8 Claims, 7 Drawing Figures

GOLF CLUB TUBE HOLDER FOR GOLF BAG

BACKGROUND OF THE INVENTION

1. Field of the Invention

This invention relates to a club holder incorporating novel features of assembly and construction enabling it to effectively secure, locate and space club separator protection tubes in a golf bag.

2. Description of the Prior Art

Generally, golfers are interested in protecting their golf clubs which to them represent a substantial monetary investment. To this end, in addition to the typical open golf bag, golf bag dividers and protection tubes have been proposed to segregate the golf clubs so that the appropriate club for the particular shot is easily selected, and the clubs are protected from damaging each other. Some of the common forms of such devices are paired plastic rings that are used to interconnect the plastic protection tubes, foam plastic spacers through which the protection tubes are fitted to hold them inside the golf bag, and devices having tubes fixedly mounted within the golf bag.

U.S. Pat. Nos. 2,781,072; 3,980,115; 2,860,679; 3,996,983; 3,101,108; and 2,938,559 are of prior art devices which have been previously designed.

There are shortcomings to the present methods employed to hold golf clubs in the golf bag in that plastic rings tend to slip and allow a protection tube to come partially out of the bag when a club is withdrawn. If this happens, the plastic ring acts in the opposite direction to prevent the tube from being easily pushed back into the golf bag. The foam plastic type tend to absorb water like a sponge when it rains on the golf course and likewise, they are easily damaged.

The present invention obviates the disadvantages of the prior art devices in that it is adaptable to hold fourteen plastic protection tubes comfortably and snugly inside an eight and one-half inch diameter or larger golf bag. The device is impervious to the effects of water and may be quickly removed for drying out the golf bag when necessary; it is relatively light weight; and it provides a unique adjustable friction clamping means for each tube which allows the tube to be inserted into the device with relative ease and which positively holds the plastic protection tube in the bag after insertion in the clamping means.

SUMMARY OF THE INVENTION

It is therefore a primary object of the present invention to provide an improved golf club tube holder and separator system for golf bags of the type set forth.

It is another object of this invention to provide a novel golf club separator system which employs resilient clamping means for securing a plurality of hollow tubular plastic club holding members therein.

It is another object of the present invention to provide a means for regulating the clamping force or pressure on the club tube members.

It is another object of this invention to provide a separator mechanism for golf club protection tubes having individual clamping means for each tube which is adapted to economically space and hold up to fourteen of such tubes inside an eight and one-half inch or larger golf bag.

It is another object of the present invention to provide a novel fastening system for securing my golf tube separating and clamping device detachably in a golf bag.

It is a further object of the present invention to provide a novel golf club separator system of light weight, durable construction which is trouble free and pleasant to use.

Other objects and a fuller understanding of the invention will be had by referring to the following description and claims of a preferred embodiment thereof, taken in conjunction with the accompanying drawings wherein like reference characters refer to similar parts throughout the several views and in which:

DESCRIPTION OF THE PREFERRED EMBODIMENT OF THE INVENTION

Figure 1:
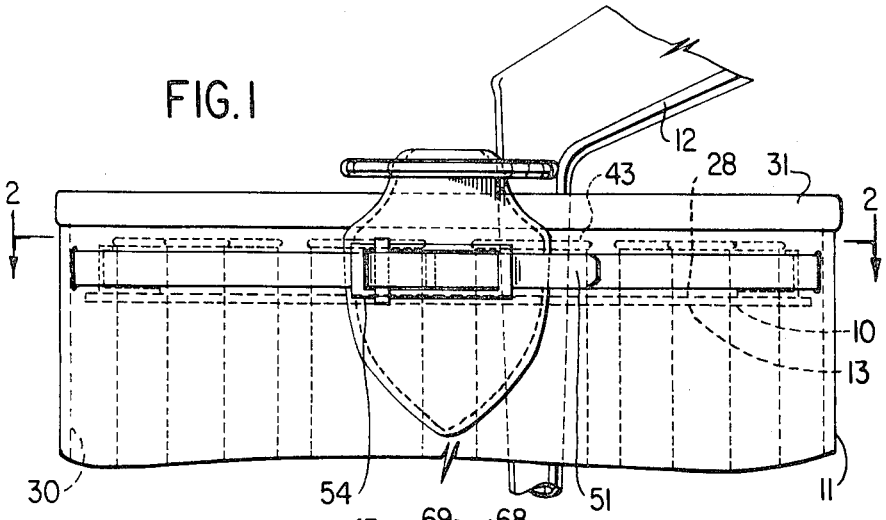
FIG. 1 is an elevational view showing the club holder of the present device installed for use in a golf bag.

Although specific terms may be used in the following description for purposes of clarity, these terms are intended to refer only to the particular structure of my invention selected for illustration in the drawings and are not intended to define or limit the scope of the invention.

Figure 2:
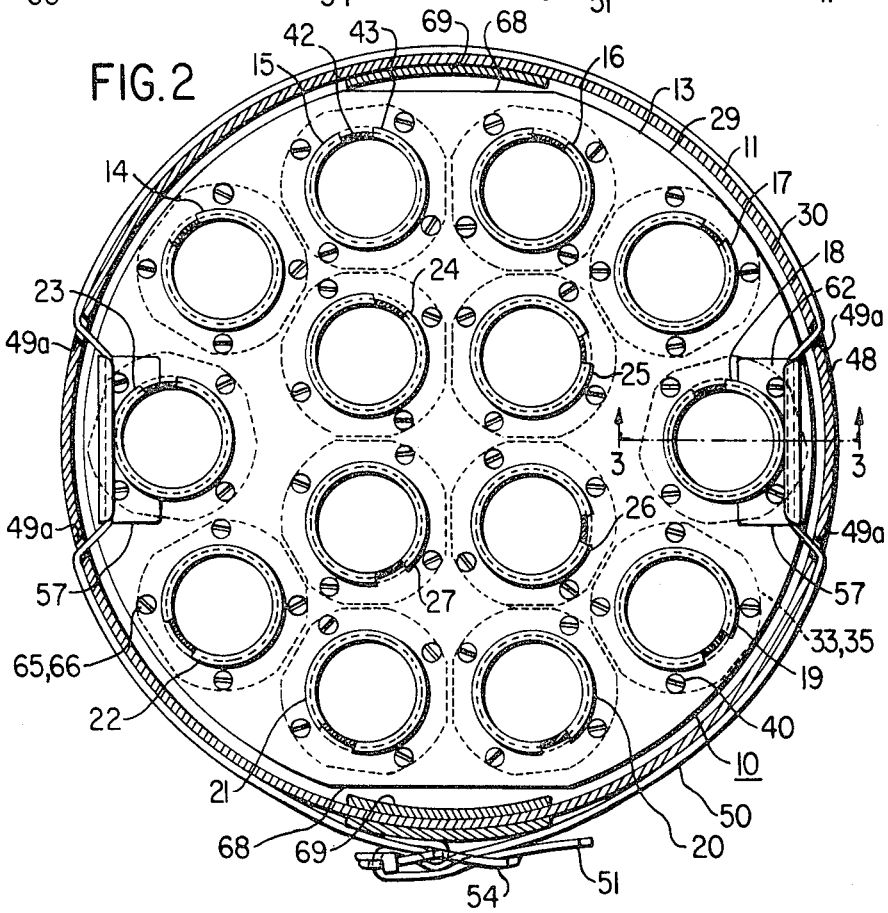
FIG. 2 is a plan view of the device of FIG. 1 taken in direction of arrows 2—2 of FIG. 1.

Referring now to the figures and more particularly to FIG. 1 and FIG. 2, I show my golf club holder 10 installed in a golf club bag 11 of conventional design suitable for holding a plurality of golf clubs 12 for different shots. In the embodiment shown, the golf bag 11 is illustrated as having a generally round cross sectional configuration. It is understood that other cross sectional configurations such as obround, oval, or the like are included within the scope of this invention.

Referring to FIGS. 1 and 2 the golf club holder 10 of the present invention includes a flat club separator plate 13. The flat plate 13 has a plurality of apertures 14, 15, 16, 17, 18, 19, 20, 21, 22, 23, 24, 24, 26, and 27 located therein. The longitudinal axes of the apertures are each substantially perpendicular to the uppermost face 28 of the flat plate 13. The plate periphery 29 is dimensioned to slip loosely within the open mouth 30 of said golf bag adjacent its lip 31.

Figure 3:
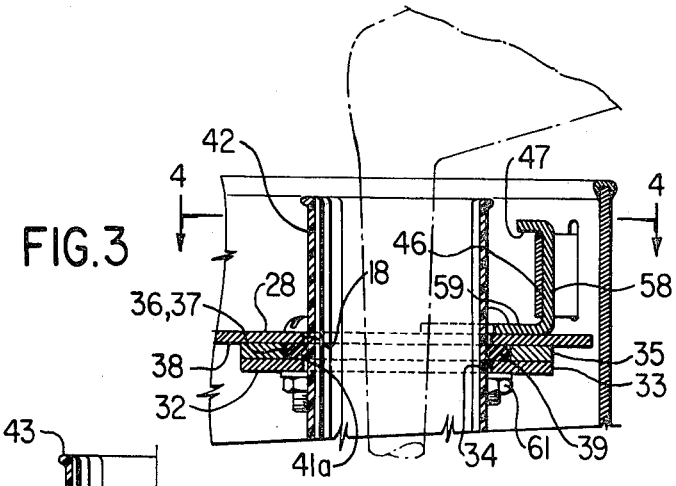
FIG. 3 is an enlarged cross sectional view of a portion of the tube holder and attaching bracket taken through lines 3—3 of FIG. 2, showing the clamp after exerting pressure on the resilient member.
Figure 4:
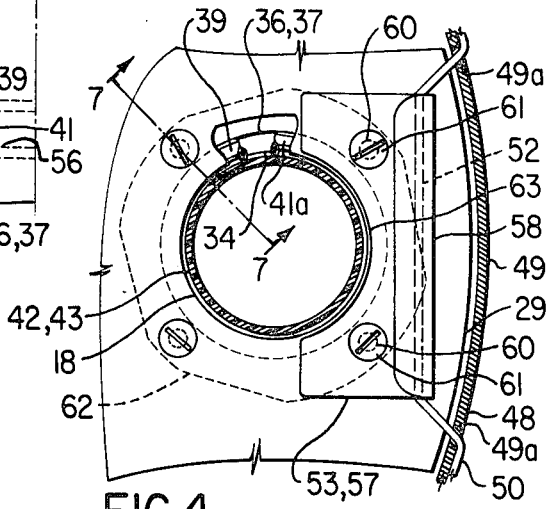
FIG. 4 is a partially cut away cross sectional plan view of FIG. 3 taken through lines 4—4 of FIG. 3.
Figure 5:
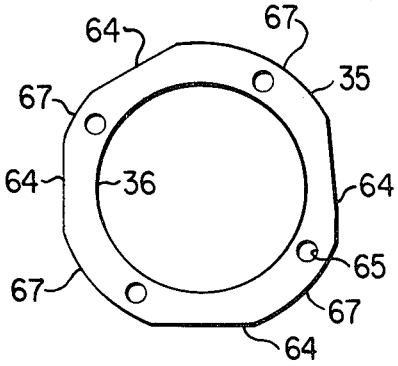
FIG. 5 is a detailed plan view of the clamp adjusting spacer member taken in direction of arrows 4—4 of FIG. 3.
Figure 6:
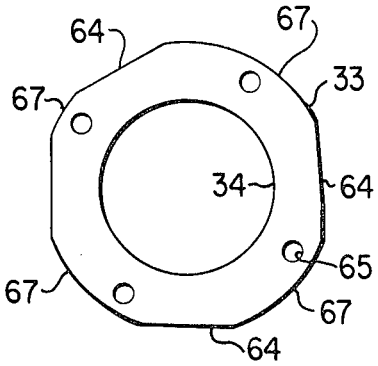
FIG. 6 is a detailed plan view of the clamp pressure plate member taken in direction of arrows 4—4 of FIG. 3.

Referring now particularly to FIGS. 3 and 4 of the drawing, a plurality of annularly outlined unitary friction clamp means 32, equal in number to the plate apertures, each includes an annularly equally outlined, flat, ring-like compression member 33 mounted to said plate beneath the lower face 38, each compression member 33 having an aperture 34 substantially equal to and axially concentric with its corresponding plate aperture. Said clamp means further includes equal, pressure regulating spacer members 35, each having a 1.5 inch diameter aperture 36 which is substantially larger than the compression plate and separator plate apertures which are preferably 1.25 inches in diameter. Said regulator member apertures define annular, vertical retaining walls 36 mounted axially with the compression plate and separator plate apertures between the separator plate and the compression plate. The separator plate aperture and compression plate aperture overlap the regulator member aperture to form a cavity 37 between the separator plate lower surface 38 and the compression plate member inside face 56.

Figure 7:
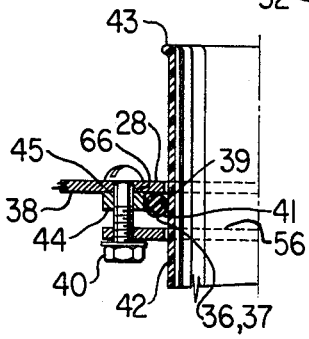
FIG. 7 is an enlarged sectional view of the same portion of the clamping means of the tube holder as FIG. 3 with the clamp pressure plate member shown prior to exerting pressure on the resilient member.

A plurality of equal, annular or circular ring-like, compressible and shape restorable resilient holding members 39 are individually mounted concentrically in the cavity 37, and are of substantially circular cross section in the uncompressed state as shown in FIG. 7.

The clamping means 32 further includes a plurality of fastening members 40 for securing said regulator members and compression plate members to said separator plate. The fastening members or nuts and bolts 40 are located perpendicularly to the separator plate, the compression plate and the regulator member, and are operable when tightened to move the compression member in the direction of the separator plate to compress the holding member walls from their relaxed circular cross section 41, FIG. 7, to an obround cross section 41*a*, as shown in FIG. 3. The holding member cannot move outwardly when compressed so that it moves inwardly from said cavity overlapping the separator and compression plate walls a substantial distance providing material to resiliently engage and forceably frictionally grip the outside walls 42 of a protection tube 43 of predetermined relative diameter to be gripped, which has been positioned in the holding member aperture, thereby securely retaining the tube in the separator plate against removal when a golf club is removed from the tube. As shown in FIG. 3, the pressure regulating spacer 35 stops the movement of the compression member at a predetermined position equal to the thickness of the regulator spacer when the inside face 56 of said compression member engages lower face 44 of said regulating member. The upper face 45 of the spacer 35 also engages the lower plate surface 38 when the compression plate member is completely tightened down. Changing the thickness of the member 35 adjusts the amount of pressure that the holding member will exert against the walls 42 of a protection tube.

The resilient holding members 39 may be of solid ring outline, however, because of cost considerations, they are preferably made from room temperature vulcanizing rubber cord stock 0.178 inches in diameter by 4.5 inches long, which fits in the cavity 37, and reacts favorably as heretofore described when compressed.

The plate apertures are 14 in number and preferably 1.25 inches in diameter. Ten of the apertures are arranged radially adjacent the periphery 29 of the plate and four more are arranged inside of the outside ten. As stated above, the compression and regulator members are preferably of annular or circular outline with a diameter of 2.06 inches, however, due to the space limitations resulting from placing of the 14 apertures in an 8½ inch circle, it is necessary to remove a chord-like portion 64 from the periphery on four sides to allow the members to nest together. The bolts and nuts or fastening means 40 are inserted through the four identical bores 65 provided in the remaining circular portion 67, which bores align with corresponding bores 66 in the separator plate. Further, the periphery 29 of the separator plate has oppositely disposed flatted portions 68 located approximately 90 degrees radially from brackets 57 to facilitate clearing of conventional interior bag abutments, such as bag reinforcements 69, when the separator plate is inserted into the mouth of the golf bag.

Two oppositely disposed, substantially interchangeable brackets 57 each having an inwardly directed foot portion 53, a flange portion 58 bent upwardly to form a wall portion 46 and bent reversely inwardly from the wall portion to form a hook-like horizontal flange portion 47 parallel to said upper surface of said separator plate and foot portion are fixedly secured to said top surface of said separator plate adjacent its periphery by spaced openings 60 in said foot portion through which the two outermost fastening members 61 of the two outermost diametrically opposite clamping means 62 are bolted. The fastening means thereby performs the dual function of compressing the holding members and securing such brackets to said aperture plate. The bracket foot portion has a semi-circular cut-out 63 at its inward end for clearing the tube when it is inserted in the plate.

The golf bag has a pair of existing oppositely and diametrically disposed generally slotted openings 49*a* which define between them an acute arc 49 on the surface or periphery 48 of the golf bag adjacent said lip. The brackets are aligned centrally radially with said openings adjacent said arc. A narrow, elongated fastening strap 50 is then placed belt-like partially around the periphery of the bag on one side between said arcs and the end 51 threaded through said arc openings to define a chord-like portion 52 forceably biased outwardly against the inside vertical wall 46 of each bracket between the inwardly reversed bracket portions 47 and the top of bracket parallel foot portion fastening wall 59. Said strap is then passed completely tightly around the remainder of the bag periphery where the end 51 of the strap is tightly joined to buckle 54.

While a specific embodiment of the invention has been shown and described, the invention is not limited to the exact details of construction set forth, and the invention embraces such changes, modifications and equivalents of the parts and their formation and arrangement as come within the purview of the appended claims.

I claim:

1. A golf club protection tube holder for golf bags, comprising in combination;

a flat plate having a plurality of apertures located therein for receiving the protection tubes, the longitudinal axis of said plate apertures located substantially perpendicular to a face of said plate and each aperture being defined by a substantially vertical wall;

means to retain said plate loosely within the interior of the golf bag;

a plurality of clamping means attached to said face of said plate, each including a spacer having a wall defining a cylindrical cavity axially aligned concentrically with said plate apertures, an annular resilient member positioned in said cavity substantially larger in thickness than the depth of said cavity, extending outwardly from the cavity, and having an aperture aligned axially with a corresponding plate aperture, a compression element having a cylindrical opening axially aligned with a plate aperture and said spacer cavity, and fastening members interconnecting said plate, said spacer and compression element, operable to draw the compression element and plate together to deform and expand the resilient member inwardly radially beyond the corresponding plate aperture wall a substantial distance to develop substantial friction between the walls of a corresponding tube and a corresponding resilient member.

2. The device of claim 1 wherein the plate retaining means includes a pair of oppositely disposed hanger members, fixedly mounted to the periphery of said plate, having channelled portions adapted to be secured to the mouth of the golf bag.

3. The device of claim 2 wherein a circular strap member inwardly engages the hangers and outwardly engages the periphery of the golf bag to fixedly secure the tube holder within the golf bag adjacent the open mouth thereof.

4. The device of claim 2 wherein the hanger members are interchangeable and the channelled portions have a flat partially concave polygonal base portion attached to the upper face of the plate associated with the clamping means, an upwardly turned outer wall portion adjacent the inner edge of the golf bag, and a ledge turned inwardly from the outer wall portion substantially parallel to said base portion.

5. The device of claim 4 wherein the hangers are fixedly located adjacent existing peripheral openings in the golf bag top, and a strap member is passed under said ledge and through said openings in the top of the golf bag.

6. The device of claim 5 wherein the strap has an adjustable fastening means at its ends thereof for fixedly securing said strap and plate tightly to said golf bag.

7. The device of claim 1 wherein said resilient member includes a member fabricated from room temperature vulcanizing rubber cord stock.

8. The device of claim 1 wherein at least some of said compression elements are equal, convex polygons nested economically spacewise with respect to each other about said plate face to accomodate 14 plastic tubes within an eight and one-half inch diameter golf bag.

* * * * *